US010753047B2

(12) United States Patent
Alsop et al.

(10) Patent No.: US 10,753,047 B2
(45) Date of Patent: Aug. 25, 2020

(54) DIRECT FIXATION FASTENER

(71) Applicant: L. B. FOSTER COMPANY, Pittsburgh, PA (US)

(72) Inventors: Robert L. Alsop, Rossville, GA (US); Arka Prabha Roy, Pittsburgh, PA (US); Michael Patrick O'Connell, Atlanta, GA (US)

(73) Assignee: L. B. Foster Company, Pittsburgh, PA (US)

( * ) Notice: Subject to any disclaimer, the term of this patent is extended or adjusted under 35 U.S.C. 154(b) by 158 days.

(21) Appl. No.: 15/647,914

(22) Filed: Jul. 12, 2017

(65) Prior Publication Data

US 2018/0016754 A1 Jan. 18, 2018

Related U.S. Application Data

(60) Provisional application No. 62/361,481, filed on Jul. 12, 2016.

(51) Int. Cl.

| | |
|---|---|
| ***E01B 9/68*** | (2006.01) |
| ***E01B 9/38*** | (2006.01) |
| ***E01B 9/62*** | (2006.01) |
| ***E01B 9/54*** | (2006.01) |

(52) U.S. Cl.

CPC ..... *E01B 9/681* (2013.01); *E01B 9/38* (2013.01); *E01B 9/54* (2013.01); *E01B 9/62* (2013.01)

(58) Field of Classification Search

CPC ..... E01B 9/00; E01B 9/02; E01B 9/38; E01B 9/62; E01B 9/68; E01B 9/681; E01B 9/683

See application file for complete search history.

(56) References Cited

U.S. PATENT DOCUMENTS

2006/0196962 A1* 9/2006 Osler ..... E01B 9/62 238/287

* cited by examiner

*Primary Examiner* — Robert J McCarry, Jr.

(74) *Attorney, Agent, or Firm* — Paul D. Bangor, Jr.; Clark Hill, PLC

(57) ABSTRACT

A bonded, direct fixation fastener as supportive structure for a rail on a railroad bed comprising: a substantially rectangular rail plate, wherein the rail plate has a generally horizontal center portion having a lower face and an upper face and wherein the rail plate defines an outer perimeter having a face defining a first angle to the railroad bed, the rail plate having attachment means to attach to the rail; a substantially rectangular bottom member defines an inner perimeter having a face defining a second angle to the railroad bed; and a substantially rectangular elastomeric portion disposed between, and bonded to each of, the outer perimeter and face of the rail plate and the inner perimeter and face of the bottom member.

16 Claims, 3 Drawing Sheets

TOP PLAN VIEW

TOP PLAN VIEW

SECTION A-A
SCALE 1 / 2

SECTION B-B
SCALE 1 / 2
TOP PLATE
ELASTOMER
Bottom Member

ISOMETRIC PROJECTION 1

ISOMETRIC PROJECTION 2

ISOMETRIC PROJECTION 3

ISOMETRIC PROJECTION 4

DIRECT FIXATION FASTENER

CROSS REFERENCE TO RELATED APPLICATIONS

This application claims the benefit of U.S. provisional patent application Ser. No. 62/361,481 filed Jul. 12, 2016, which is incorporated by reference herein for all purposes.

FIELD OF THE DISCLOSURE

This present disclosure is related to a direct fixation fastener for attaching a rail to a railroad bed.

BACKGROUND

Bonded direct fixation fasteners (BDFFs) have been used by transit agencies in the United States for many decades. The BDFF design provides a one component solution for the unique needs of the transit railroad systems. Dynamic stiffness of the BDFFs dictates the noise and vibration mitigation performance of the BDFFs. While achieving the desired amount of noise and vibration mitigation, BDFFs must also withstand cyclic wheel loads in diverse environmental conditions for many years. Historically, BDFFs have been made using one grade of rubber and the vertical and lateral stiffness characteristics of BDFFs have been governed by a combination of the geometric details of the design and the properties of the rubber used in the BDFF.

BDFFs with low vertical stiffness are commonly sought to create softer cushions under the rails to provide higher noise and vibration reduction. When the geometrical constraints are set by the end user or track conditions, designers are usually left with softening the rubber element to achieve better noise and vibration reduction. When BDFFs are made softer in the vertical direction, they become softer in the lateral direction as well, which undesirably leads to premature failures under repeated cyclic loading and also to higher lateral deflection of the rail head.

BRIEF SUMMARY OF THE INVENTION

Many other variations are possible with the present disclosure, and those and other teachings, variations, and advantages of the present disclosure will become apparent from the description and figures of the disclosure.

One aspect of a preferred embodiment of the present disclosure comprises a bonded, direct fixation fastener as supportive structure for a rail on a railroad bed comprising: a substantially rectangular rail plate, wherein the rail plate has a generally horizontal center portion having a lower face and an upper face and wherein the rail plate defines an outer perimeter having a face defining a first angle to the railroad bed, the rail plate having attachment means to attach to the rail; a substantially rectangular bottom member defines an inner perimeter having a face defining a second angle to the railroad bed; and a substantially rectangular elastomeric portion disposed between, and bonded to each of, the outer perimeter and face of the rail plate and the inner perimeter and face of the bottom member.

In another aspect of a preferred bonded, direct fixation fastener of the present disclosure, the bottom member and rail plate are cast steel or ductile iron.

In yet another aspect, a preferred bonded, direct fixation fastener of the present disclosure further comprises a rail attachment means comprising channels to receive rail fastening means.

In another aspect of a preferred bonded, direct fixation fastener of the present disclosure, the rail fastening means is a rail clip made of spring steel.

In yet another aspect, a preferred bonded, direct fixation fastener of the present disclosure further comprises a bottom member attachment means for attaching to the railroad bed comprising an aperture for receiving bottom member fastening means.

In another aspect of a preferred bonded, direct fixation fastener of the present disclosure, the bottom member fastening means is selected from the group consisting of a spring, clip, clamp, spike, bolt, and bolt clamp.

In yet another aspect of a preferred bonded, direct fixation fastener of the present disclosure, the elastomeric portion is composed of rubber.

In another aspect of a preferred bonded, direct fixation fastener of the present disclosure, the elastomeric portion comprises rubber.

In a further aspect of a preferred bonded, direct fixation fastener of the present disclosure, the first angle is constant all around the outer perimeter of the rail plate.

In another aspect of a preferred bonded, direct fixation fastener of the present disclosure, the second angle is constant all around the inner perimeter of the bottom member.

In yet another aspect of a preferred bonded, direct fixation fastener of the present disclosure, the first angle is equal or substantially equal to the second angle and each of the first angle and second angle is between about 55° to about 70°.

In another aspect of a preferred bonded, direct fixation fastener of the present disclosure, the elastomeric portion has a uniform or substantially uniform thickness.

In an additional aspect of a preferred bonded, direct fixation fastener of the present disclosure, the elastomeric portion has a hardness of about 47 to about 67 durometer.

In another aspect of a preferred bonded, direct fixation fastener of the present disclosure, the elastomeric portion has a hardness of about 57 to about 67 durometer.

In yet another aspect of a preferred bonded, direct fixation fastener of the present disclosure, the bonded, direct fixation fastener produces a vertical spring-rate in the range of 42000 lbs/in to 61000 lbs/in.

In an additional aspect of a preferred bonded, direct fixation fastener of the present disclosure, the first angle is equal or substantially equal to the second angle and each of the first angle and second angle is between about 55° to about 60°.

In another aspect of a preferred bonded, direct fixation fastener of the present disclosure, the elastomeric portion has a hardness of about 47 to about 57 durometer.

In yet another aspect of a preferred bonded, direct fixation fastener of the present disclosure, the elastomeric portion has a hardness of about 57 to about 67 durometer, and the first angle is equal or substantially equal to the second angle and each of the first angle and second angle is between about 55° to about 65°.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "invention" merely for convenience and without intending to voluntarily limit the scope of this application to any single disclosure or inventive concept if more than one is in fact disclosed.

The following description is, therefore, not to be taken in a limited sense, and the scope of the inventive subject matter is defined by the appended claims and their equivalents.

Figures 1, 1A, 1B:
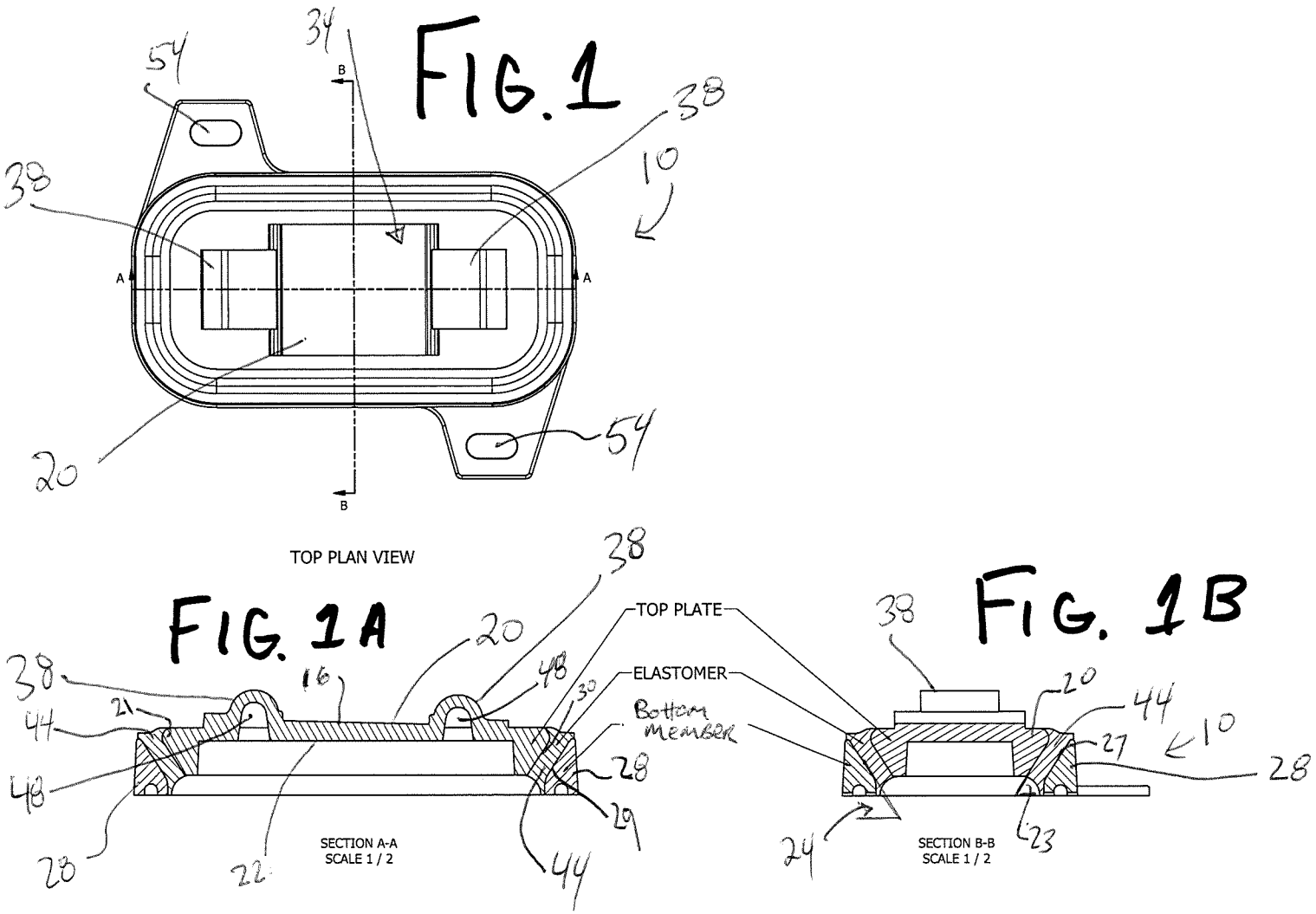
FIG. 1 is a top plan view of the direct fixation fastener of the present disclosure.
FIG. 1A is a cross-sectional view thereof along line A-A of FIG. 1.
FIG. 1B is a cross-sectional view thereof along line B-B of FIG. 1.
Figure 2:
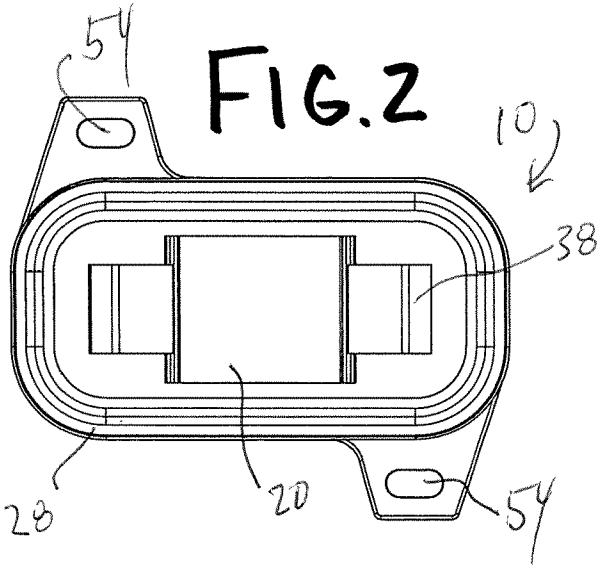
FIG. 2 is a top plan view thereof.
Figure 3:
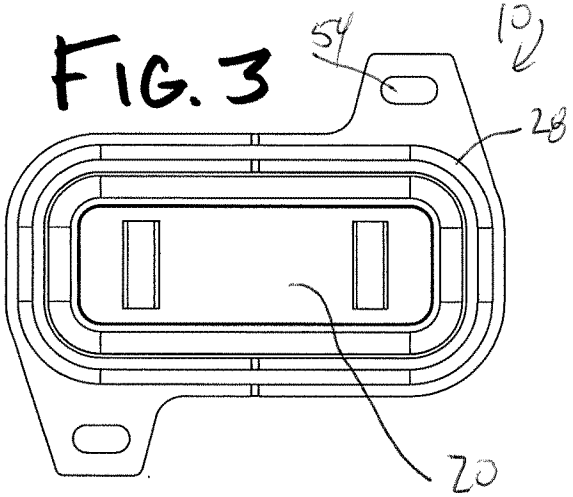
FIG. 3 is a bottom plan view thereof.
Figure 4:
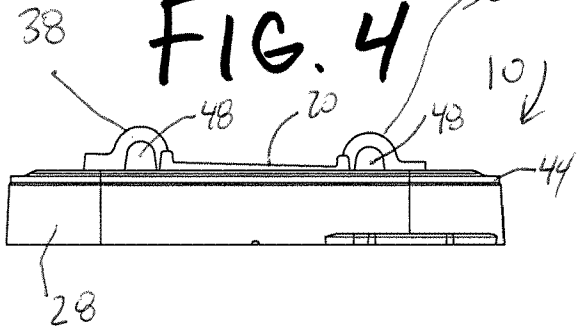
FIG. 4 is a front elevational view thereof.
Figure 5:
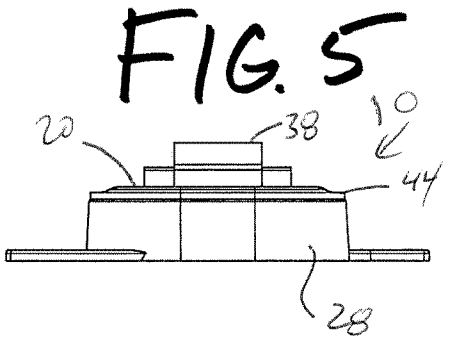
FIG. 5 is a right elevational view thereof.
Figure 6:
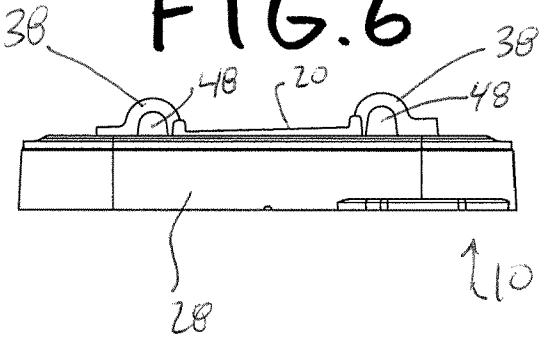
FIG. 6 is a rear elevational view thereof.
Figure 7:
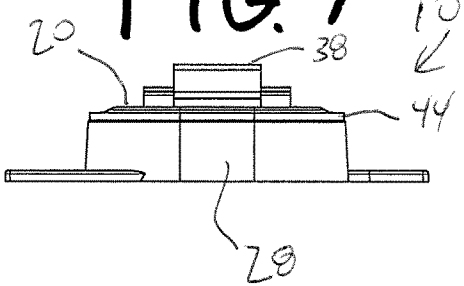
FIG. 7 is a left elevational view thereof.
Figure 8:
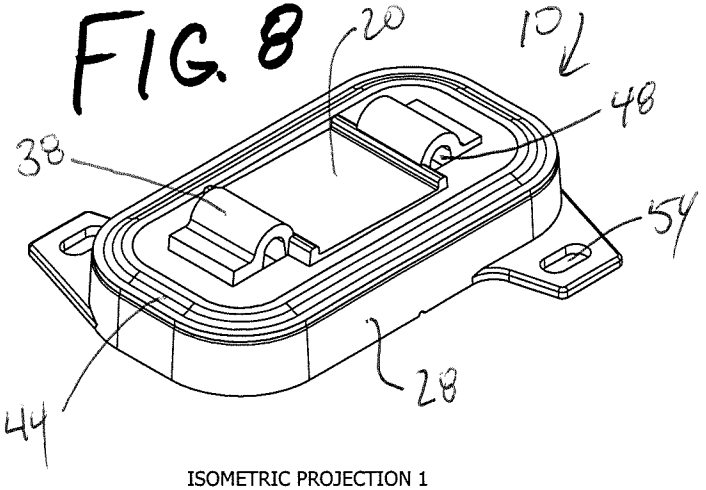
FIG. 8 is a top right front perspective view thereof.
Figure 9:
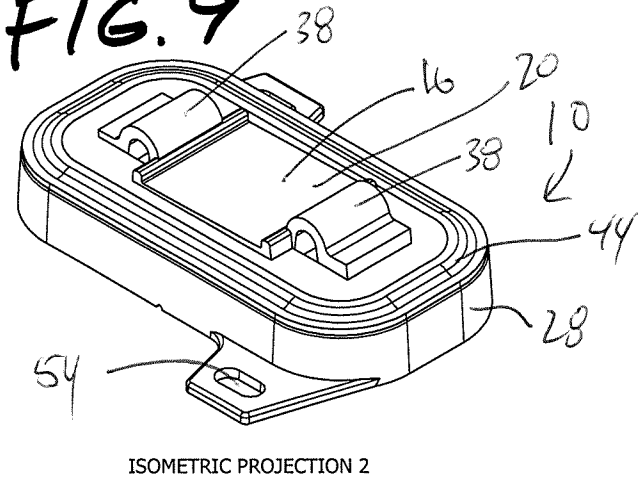
FIG. 9 is a top left front perspective view thereof.
Figure 10:
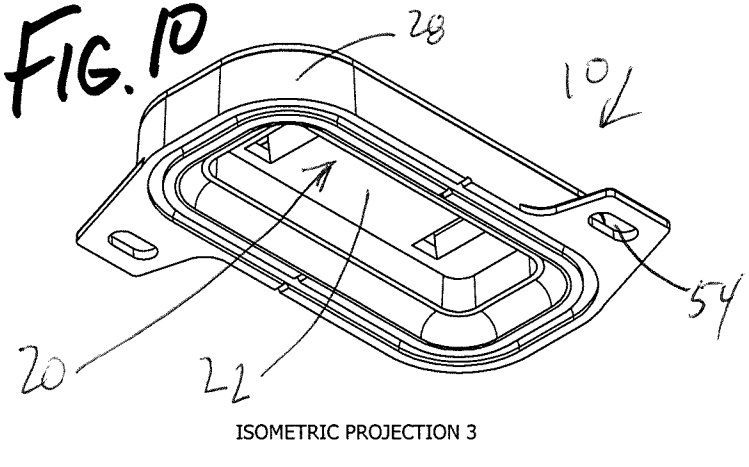
FIG. 10 is a bottom left front perspective view thereof.
Figure 11:
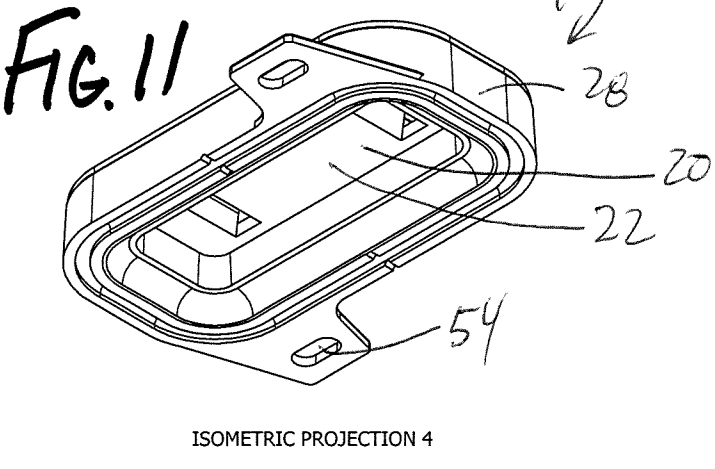
FIG. 11 is a bottom right front perspective view thereof.

An illustrated preferred embodiment of the dual durometer BDFF 10 of the present disclosure is shown in FIGS. 1-11. The BDFF 10 comprises a substantially rectangular rail plate 20, wherein the rail plate 20 has a generally horizontal rectangular flat center portion 34 having a lower face 22 and an upper face 16. The rail plate 20 has an outer perimeter 21 having a face 30 defining a first angle 23 preferably of about 55° to 70° or also preferably from about 55° to 65° or also preferably from about 55° to 60° to a generally flat horizontal rail bed (not shown). The rail plate 20 has rail attachment means 38 to attach the rail plate 20 to a railroad rail (not shown). The rail plate 20 may be made of any durable metal or alloy, and is preferably made of cast steel or ductile iron.

A preferred embodiment of the BDFF 10 of the present disclosure further comprises a substantially rectangular bottom member 28, having an interior perimeter 29 having a face 27 defining a second angle 24, preferably of about 55° to 70° or also preferably from about 55° to 65° or also preferably from about 55° to 60° to a generally flat horizontal rail bed (not shown). The bottom member 28 may be made of any durable metal or alloy, and is preferably made of cast steel or ductile iron.

Between the rail plate 20 and the bottom member 28 is an elastomeric portion 44 of relatively lower durometer hardness, preferably in the range of 47 to 67 durometer and more preferably in the range of 57 to 67 durometer, bonded to the bottom member interior perimeter 29 and face 27 and to the rail plate outer perimeter 21 and face 30. Preferably, the elastomeric portion 44 is of relatively uniform thickness all the way around the BDFF 10.

The rail attachment means 38 may be any as used in the rail industry. In a preferred embodiment, at least one channel 48 is formed in the rail plate 20. Preferably, the rail plate 20 may be attached to a railroad rail by means of the channel 48 using a clip (not shown). More preferably, the clip may comprise a spring clip of a Pandrol design which is in standard use in the rail industry.

The bottom member 28 is preferably adapted to be attached to the rail bed (not shown). More preferably, the adaption is an aperture 54 in the bottom member 28. The bottom member 28 may be attached by any means used in the rail industry including spikes, screws, bolts, clips, spring clips, and bolt clamps.

Preferably the BDFF 10 of the present disclosure produces a vertical spring-rate in the range of 42000 lbs/in to 61000 lbs/in.

In the foregoing Detailed Description, various features are grouped together in a single embodiment to streamline the disclosure. This method of disclosure is not to be interpreted as reflecting an intention that the claimed embodiments of the disclosure require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A bonded, direct fixation fastener as supportive structure for a rail on a railroad bed comprising:

a rectangular rail plate, wherein the rail plate has a generally horizontal and rectangular center portion having a lower face and an upper face and first and second opposed sides and wherein the rail plate defines an outer perimeter having a face defining a first angle to the railroad bed, the rail plate having first and second attachment means to attach to the rail, wherein the first attachment means is centered on the first side of the generally horizontal and rectangular center portion and the second attachment means is centered on the second side of the generally horizontal and rectangular center portion;

a rectangular bottom member defines an inner perimeter having a face defining a second angle to the railroad bed; and a rectangular elastomeric portion disposed between, and bonded to each of, the outer perimeter and face of the rail plate and the inner perimeter and face of the bottom member.

2. The bonded, direct fixation fastener of claim 1 wherein the bottom member and rail plate are cast steel or ductile iron.

3. The bonded, direct fixation fastener of claim 1 further comprising a rail attachment means comprising channels to receive rail fastening means.

4. The bonded, direct fixation fastener of claim 1 further comprising a bottom member attachment means for attaching to the railroad bed comprising an aperture for receiving bottom member fastening means.

5. The direct fixation fastener of claim 1 wherein the elastomeric portion is composed of rubber.

6. The direct fixation fastener of claim 1 wherein the elastomeric portion comprises rubber.

7. The direct fixation fastener of claim 1 wherein the first angle is constant all around the outer perimeter of the rail plate.

8. The direct fixation fastener of claim 1 wherein the second angle is constant all around the inner perimeter of the bottom member.

9. The direct fixation fastener of claim 1 wherein the first angle is equal or substantially equal to the second angle and each of the first angle and second angle is between about 55° to about 70°.

10. The direct fixation fastener of claim 1 wherein the elastomeric portion has a uniform or substantially uniform thickness.

11. The direct fixation fastener of claim 1 wherein the elastomeric portion has a hardness of about 47 to about 67 durometer.

12. The direct fixation fastener of claim 1 wherein the elastomeric portion has a hardness of about 57 to about 67 durometer.

13. The direct fixation fastener of claim 12 wherein the first angle is equal or substantially equal to the second angle and each of the first angle and second angle is between about 55° to about 65°.

14. The direct fixation fastener of claim 1 that produces a vertical spring-rate in the range of 42000 lbs/in to 61000 lbs/in.

15. The direct fixation fastener of claim 1 wherein the first angle is equal or substantially equal to the second angle and each of the first angle and second angle is between about 55° to about 60°.

16. The direct fixation fastener of claim 1 wherein the elastomeric portion has a hardness of about 47 to about 57 durometer.

* * * * *